US005242263A

United States Patent [19]

Mondoloni

[11] Patent Number: 5,242,263

[45] Date of Patent: Sep. 7, 1993

[54] DEVICE FOR THE CONTROL OF ANTI-SURGE OF A COMPRESSOR

[75] Inventor: Jean-Louis Mondoloni, Pierre de Varennes, France

[73] Assignee: Framatome, Courbevoie, France

[21] Appl. No.: 762,464

[22] Filed: Sep. 19, 1991

[30] Foreign Application Priority Data

Sep. 19, 1990 [FR] France ..... 90 11575

[51] Int. Cl.[5] ..... F04D 27/02

[52] U.S. Cl. ..... 415/27; 415/1; 415/28

[58] Field of Search ..... 415/1, 26, 27, 28, 29

[56] References Cited

U.S. PATENT DOCUMENTS

| | | | |
|---|---|---|---|
| 4,230,437 | 10/1980 | Bellinger et al. | 415/1 |
| 4,486,142 | 12/1984 | Staroselsky | 415/1 |
| 4,656,589 | 4/1987 | Albers et al. | 415/1 |
| 4,781,524 | 1/1988 | Blotenberg | 415/1 |
| 4,789,298 | 12/1988 | Blotenberg | 415/1 |
| 4,796,213 | 1/1989 | Blotenberg | 415/1 |
| 4,831,534 | 5/1989 | Blotenberg | 415/1 |
| 4,831,535 | 5/1989 | Blotenberg | 415/1 |
| 4,936,740 | 6/1990 | Blotenberg | 415/26 |
| 4,938,658 | 7/1990 | Blotenberg | 415/1 |

FOREIGN PATENT DOCUMENTS

| | | |
|---|---|---|
| 0336092 | 2/1989 | European Pat. Off. . |
| 808094 | 1/1959 | United Kingdom . |
| 2002451 | 7/1978 | United Kingdom . |

*Primary Examiner*—Edward K. Look
*Assistant Examiner*—Michael S. Lee
*Attorney, Agent, or Firm*—Pollock, Vande Sande & Priddy

[57] ABSTRACT

An anti-surge valve (11) equipped with a servomotor and connected between the outlet of the compressor (12) and its inlet, the servomotor being controlled from a regulating system (13) which receives at the input a parameter (m) representing the flow of the compressor and a nominal value (c) determined from the inlet pressure and outlet pressure of the latter, for the purpose of injecting some of the outlet flow of the compressor at the inlet of this, in order to keep it above its breakaway point. The device comprises a quick-emptying solenoid valve (16) of the servomotor of the anti-surge valve and means (17, 18) for controlling this as a function of the amount of deviation between the parameter and the nominal value.

23 Claims, 2 Drawing Sheets

DEVICE FOR THE CONTROL OF ANTI-SURGE OF A COMPRESSOR

FIELD OF THE INVENTION

The present invention relates to a device for the control of anti-surge means of a compressor.

BACKGROUND OF THE INVENTION

Every compressor has an instability zone in which it must not operate. Consequently, the control devices of these compressors include an anti-surge valve equipped with a servomotor and connected between the outlet and inlet of the compressor.

The servomotor of such an anti-surge valve is controlled by regulating means which receive at the input a parameter representing the flow of the compressor and a nominal value determined from the inlet pressure and outlet pressure of the compressor, for the purpose of injecting some of the outlet flow of the compressor at its inlet, in order to keep the compressor above its breakaway point.

However, prior art devices have disadvantages, because the anti-surge valves have a very long response time and the incursions of the compressor on either side of its nominal operating point are relatively pronounced and can cause the compressor to go past its breakaway point and reach a state of instability, and it is then impossible to return it to normal operation without stopping it.

Prior art solutions involve shifting the safety curve of the compressor so as to move it away from its instability zone, to prevent the incursions on either side of its nominal operating point from causing the compressor to cross its breakaway point.

This solution is not very satisfactory, inasmuch as the powers of compressors tend to increase more and more and/or their response times have to be as short as possible. Moreover, these devices are also limited by the stability of the regulating means.

SUMMARY OF THE INVENTION

The object of the invention is, therefore, to solve these problems by providing a device for the control of anti-surge means of a compressor which is simple and reliable and which makes it possible to control the operation of the compressor very quickly and in complete safety.

To this end, the subject of the invention is a device for the control of anti-surge means of a compressor, comprising an anti-surge valve equipped with a servomotor and connected between the outlet of the compressor and its inlet, the servomotor being controlled from regulating means which receive at the input a parameter representing the flow of the compressor and a nominal value determined from the inlet pressure and outlet pressure of the compressor, for the purpose of injecting some of the outlet flow of the compressor at its inlet, in order to keep it above its breakaway point. The device comprises a quick-emptying solenoid valve of the servomotor of the anti-surge valve and means for controlling this solenoid valve as a function the amount of deviation between the parameter and the nominal value.

BRIEF DESCRIPTION OF THE DRAWINGS

The invention will be better understood from the following description given by way of example and with reference to the accompanying drawings, in which.

DETAILED DESCRIPTION

Figure 1:
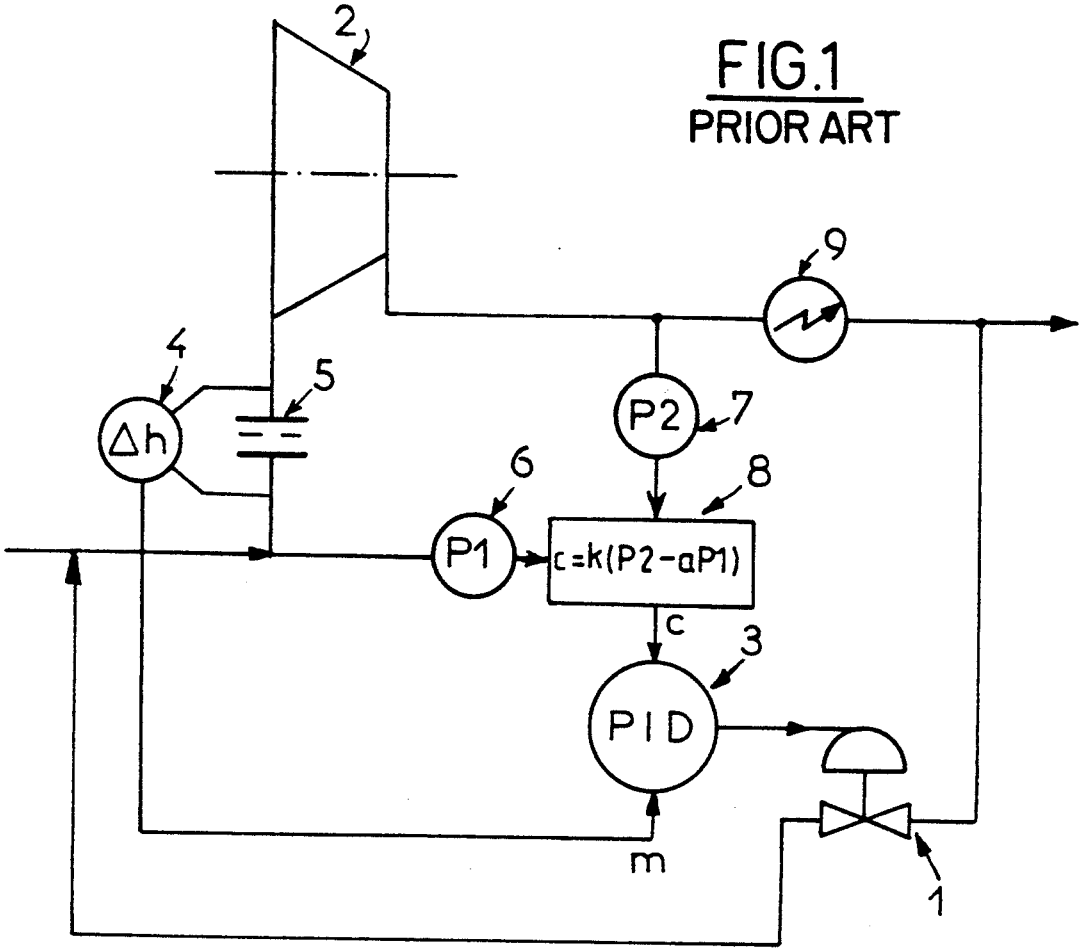
FIG.1 PRIOR ART
FIG. 1 is a block diagram of a prior art control device.

As can be seen in FIG. 1, a prior art device for the control of anti-surge means of a compressor comprises an anti-surge valve 1 connected between the outlet and the inlet of a compressor 2.

This anti-surge valve comprises a servomotor which is controlled from regulating means 3 which receive at one input a parameter representing the flow of the compressor, this parameter m coming from measuring means 4 connected, for example, to the terminals of a conventional vacuum member 5 connected to the inlet of the compressor.

These regulating means 3 likewise receive at the input a nominal value c determined from the inlet pressure P1 and outlet pressure P2 of the compressor and supplied respectively by sensors 6 and 7, the inputs of which are connected respectively to the inlet and to the outlet of the compressor and the outputs of which are connected to a nominal-value computer 8 making it possible to determine nominal value c from the two pressures mentioned above and from a formula of the type:

$$c=K(P_2-AP_1),$$

K and A being constants determined in the conventional manner as a function of the equipment.

The regulating means 3 can consist of a PID controller which, as mentioned above, makes it possible to control the anti-surge valve and more particularly its servomotor when the compressor operates in a zone near to its breakaway point.

It will also be noted that cooling means 9 are provided at the outlet of the compressor in a manner known per se.

As mentioned above, this structure has some disadvantages, particularly as regards the response speed of the assembly and the stability of the regulating means.

Figure 2:
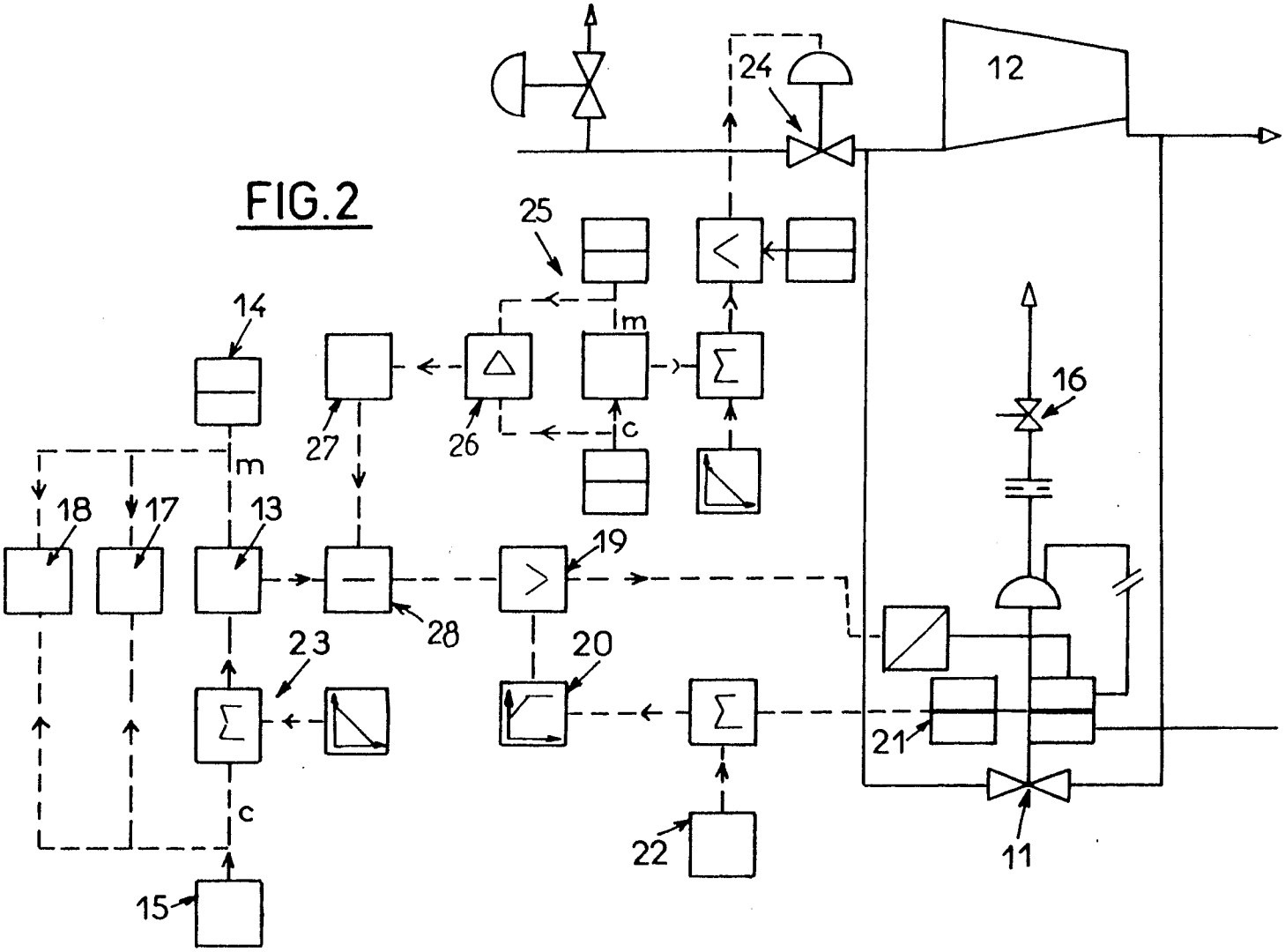
FIG. 2 is a block diagram of a control device according to the invention.

As shown in FIG. 2, the basic diagram of the control device according to the invention also comprises an anti-surge valve 11 connected between the outlet and inlet of a compressor 12. This anti-surge valve comprises a servomotor controlled from regulating means 13 which receive, at one input, a parameter m representing the flow of the compressor and supplied, for example, by measuring means 14 connected to a vacuum member at the inlet of the compressor and, at another input a nominal value c supplied by computing means 15 making it possible to determine this nominal value from the inlet pressure and outlet pressure of the compressor as explained above, for the purpose of controlling the anti-surge valve and injecting some of the outlet flow of the compressor at its inlet, in order to keep it above its breakaway point. This regulation is conventional and has already been described.

According to the invention, a quick-emptying solenoid valve 16 of the servomotor of the anti-surge valve 11 is used to improve the response speed of the latter, and is actuated by control means as a function of the amount of deviation between the parameter m representing the flow of the compressor and the nominal value c.

The control means comprise, for example, a computing member 17 receiving, at one input, the parameter m coming from the measuring means 14 and, at another input, the nominal value c coming from the computing means 15, the output of these computing means 17 controlling the opening of the solenoid valve when the deviation between the parameter and the nominal value is greater than a first threshold which will hereafter be called DSH.

Thus, the opening of this quick-emptying solenoid valve of the servomotor of the anti-surge valve makes it possible to accelerate the response of this anti-surge valve under the control of the regulating means when a compressor approaches its breakaway point.

In response to this control of the quick-emptying solenoid valve of the servomotor and of the anti-surge valve, some of the outlet flow of the compressor is recycled at its inlet, so that the operating point of the compressor moves away from its breakaway point very quickly.

The closing of the quick-emptying solenoid valve of the anti-surge valve can then be controlled when the deviation between the parameter m representing the flow of the compressor and the nominal value c diminishes below this first threshold DSH or a second threshold which will hereafter be called DSL.

For this purpose, computing means 18 are connected in parallel to the computing means 17 and receive at one input the parameter m and at another input the nominal value c, in order to determine the deviation between these two values and to compare this deviation with the threshold DSL, so as to control closing of the quick-emptying solenoid valve 16 accordingly.

To improve the operation o the control device, the output of the regulating means 13 can be connected to means 19 for selecting a low level which therefore receive, at one input, the output of these regulating means 13 and, at another input, the output of a time-increasing ramp generator 20 in order to direct towards the servomotor of the anti-surge valve the lowest signal at the output of the regulating means and of the ramp generator.

The ramp makes it possible to improve the progressive return of the assembly to normal operation. The law of increase of this ramp may be linear, logarithmic, or of any other type.

Of course, the ramp must start at a safety level preventing the surge of the compressor, whatever its operating state, advantageously at a level determined by the position of the anti-surge valve, more particularly of its shutter, at the moment of closing of the emptying solenoid valve.

For this purpose, means 21 for copying the position of this anti-surge valve can be provided. The output of these means 21 is connected to the input of the ramp generator 20, in order to start the ramp at a level corresponding to the position of the shutter of the anti-surge valve at the moment of closing of the emptying solenoid valve.

It is also possible to provide compensating means 22 making it possible to add to the output signal from the solenoid-valve position copying means a signal compensating the copying error or compensating faults of the solenoid valve, for example the closing delay of the latter which can be of the order of 40 ms.

The compensating signal is determined as a function of the characteristics of the anti-surge valve.

Still with a view to improving the operation of the device, the latter may also be provided with means 23 for adding a time-decreasing ramp to the nominal value c, these means being interposed between the nominal-value computing means 15 and the corresponding input of the regulating means 13. The law of decrease of this ramp can be linear, hyperbolic, or of any other type. The duration of the ramp is in close reaction to that used for the closing ramp, since it is necessary to ensure that the extra protection still exists when the closing ramp reaches 100%. The start of this ramp is determined as a function of the control of the emptying solenoid valve, and more particularly it can be controlled at the opening of this valve.

Figure 3:
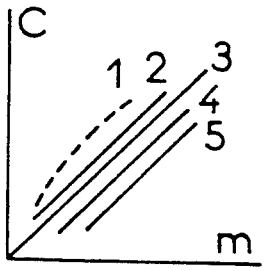
FIG. 3 is a graph illustrating the operation of a control device according to the invention.

The operation of such a device is described with reference to FIG. 3 which is a nominal-value c/parameter m graph.

On this graph, the curve 1 represents the true surge line of the compressor, and to the right of this curve is a DSH action curve 2 corresponding to the first threshold mentioned above.

The curve 3 represents the straight line protecting the nominal value c, and the computing means 17 compute the deviating between the operating point of the compressor and this protective straight line c in the direction of the DSH action line in order to trigger the opening of the anti-surge valve when this DSH action line is reached or exceeded.

The straight line designated by 4 represents the temporary extra protection line which relates to the addition of the ramp of the generator 23 to the nominal value and which makes it possible to return the device towards normal operation in a much more flexible way.

Finally, the straight line designated by 5 is a desaturation line corresponding to the threshold DSL, allowing the device to close the quick-emptying solenoid valve of the servomotor of the anti-surge valve when this threshold is reached or exceeded, and also to ensure the desaturation of this anti-surge valve when the operating point of the compressor passes to the left of this curve, in order to improve the response speed of the assembly, as will be described in more detail hereinbelow.

During normal operation, the device according to the invention adjusts the opening of the anti-surge valve in order to ensure that the compressor has a minimum flow for the purpose of preventing the latter from entering its zone of unstable operation.

The quick-emptying solenoid valve of the servomotor of this anti-surge valve is closed and the output of the ramp generator 20 connected to the output of the regulating means 13 is saturated, with the result that the output of the regulating means 13 is present again at the output of these selection means.

The PID actions of the regulating means are optimized to obtain as high a response speed as possible compatible with the stability of the control loop and the other controls of the assembly connected to the outlet of the compressor.

In the event of disturbance of this assembly such that the regulating means do not succeed in avoiding a parameter/nominal-valve deviation lower than the first specific threshold DSH in the surge direction, this threshold DSH is reached and the device then takes over the safety control of the anti-surge valve, firstly by forcing this anti-surge valve to open, particularly as a result of action on the quick-emptying solenoid valve, and secondly by incrementing the nominal value, i.e., by triggering the ramp generator 23 connected to the nominal-value input of the regulating means 13.

These safety actions are maintained for as many scanning cycles of the controller as are necessary to reach the threshold DSL corresponding to a parameter/nominal-value deviation towards high flows of the compressor. The device then recloses the emptying solenoid valve and takes into account the actual opening of the anti-surge valve by the copying means 21 in order to initialize the ramp generator 20.

From that moment on, the anti-surge valve recloses according to the setting of this ramp at the output of the generator 20 and, at the approach to the temporary extra protection curve, hands over to normal regulating means.

The temporary extra protection is thus progressively cancelled according to this ramp at the output of the generator 20. It will also be noted that the servomotors of anti-surge valves generally operate at a higher drive pressure than is strictly necessary, in order to obtain the best possible level of sealing. This saturation pressure is used to lay the shutter of the solenoid valve very firmly onto its seat in order to prevent any leaks.

To improve the response speed of the device, it is possible to employ the second threshold DSL to desaturate the servomotor of the anti-surge valve when this threshold is reached, i.e., when the deviation between the parameter and the nominal value is lower than the second level DSL. For this purpose, two different pressure sources are used, according to choice, via a solenoid valve in dependence on the threshold DSL.

In fact, under these conditions, the compressor enters an operating zone near to the zone in which it is expedient to control the anti-surge valve, and by previously desaturating the servomotor of its valve the response speed of the latter and therefore of the assembly is improved.

It will also be noted that means for counting during a specific time the number of occasions when the parameter/nominal-value deviation becomes greater than the first level DSH can be used in order to trigger an alarm when this number is greater than a specific value.

In fact, at this point it can be considered that the device is not operational and, for example, that the anti-surge valve has a fault and that it is expedient to warn the users of this fault before any damage occurs to the assembly.

It is also possible to anticipate disturbances by action on the inlet-regulating valve 24 of the compressor, shown in FIG. 2.

In fact, to avoid the residual idle time of the anti-surge valve at the call-up of the computing means 17, it is possible to send a brief additional opening pulse to the control of inlet-regulating valve 24 which is always under regulation.

Thus, the compressor receives an additional flow immediately, even before the anti-surge valve can act. The flow which passes through the inlet valve is a function of its upstream pressure, of its downstream pressure and of its opening.

The inlet pressure of a compressor operating in the vicinity of its protection and connected to a delivery network varies very little as a function of the recycled flow, and this means that oscillations of the anti-surge valve cannot destabilize the regulation of the inlet pressure of the compressor.

Conversely, any oscillation of the position of the inlet valve is perceived as a variation in the measurement of the differential pressure $\Delta h$, i.e., of the parameter m, thus making necessary for the anti-surge regulation to attempt to compensate variations originating from the regulation of the inlet pressure of the compressor.

To avoid this conflict, the opening of the inlet valve is linked to the opening of the anti-surge valve, so that the inlet flow of the compressor is as constant as possible in the event of an oscillation of the position of the inlet valve. The various control means used for this purpose are designated by 25 in FIG. 2.

Thus, a deviation which occurs between the measurement and the nominal value regulating the process and is computed in the module 26, and the amplitude of which is modified in the following gain module 27, and which produces, for example, an opening of the inlet valve, gives rise directly, by subtraction at 28 at the outlet of the controller 13, to a corresponding closing of the anti-surge valve, without the controller 13 having to intervene.

In the example described, the illustration is made in terms of a regulation of suction pressure acting on an inlet valve of the compressor, but the same principle can apply, whatever the parameter to be regulated (suction pressure, delivery pressure, flow, etc.) and whatever the means (inlet valve, delivery valve, speed, etc.) used for regulating the process, without conflict with the anti-surge.

I claim:

1. Device for the control of anti-surge means of a compressor, said device comprising an anti-surge valve (11) equipped with a servomotor and connected between an outlet and an inlet of said compressor (12), said servomotor being controlled from regulating means (13) having an input which receives a parameter (m) representing a flow of said compressor and a nominal value (c) determined from an inlet pressure (P1) and an outlet pressure (P2) of said compressor, for the purpose of injecting parts of an outlet flow of said compressor at said inlet of said compressor, in order to keep said compressor above a breakaway point of said compressor, wherein said device further comprises a quick-emptying solenoid valve (16) of the servomotor of the anti-surge valve and means (17, 18) for controlling said solenoid valve and a state of saturation or desaturation of said servomotor as a function of an amount of deviation between said parameter and said nominal value.

2. Device according to claim 1, comprising means (17) for controlling opening of said solenoid valve when said deviation is greater than a first threshold (DSH).

3. Device according to claim 2, comprising means (17) for controlling closing of said solenoid valve when said deviation is lower than said first threshold (DSH).

4. Device according to claim 2, comprising means (18) for controlling closing of said solenoid valve when said deviation is greater than a second threshold (DSL).

5. Device according to any one of claims 1 to 4, wherein an output of said regulating means (13) is connected to means (19) for selecting a low level which receive at another input an output of a time-increasing ramp generator (20), in order to direct the lower signal towards said servomotor of said anti-surge valve.

6. Device according to claim 5, wherein said means for generating said ramp (20) are triggered at a safety level preventing a surge of said compressor, whatever its operating state.

7. Device according to claim 5, wherein said ramp generator is connected to means (21) for copying a position of said anti-surge valve in order to trigger said ramp at a level determined from the position of said anti-surge valve at a moment of closing of said quick-emptying solenoid valve.

8. Device according to claim 5, comprising means (23) for adding a time-decreasing ramp to the nominal value (c), triggering of said time-decreasing ramp being determined as a function of the control of said quick-emptying solenoid valve.

9. Device according to claim 8, wherein said addition means (23) are triggered at the opening of said emptying solenoid valve.

10. Device according to claim 5, comprising means (18) for desaturating said servomotor of said anti-surge valve when said deviation is lower than said second level (DSL).

11. Device according to claim 5, comprising means for counting, during a specific time, a number of occasions when said deviation between said nominal value and the measurement becomes greater than said first level (DSH), in order to trigger an alarm when said number is greater than a predetermined value.

12. Device according to claim 5, comprising means (26, 27, 28) for limiting conflict between regulation of the process and the anti-surge control from a measurement/nominal-value deviation, acting on the output of said regulating means (13) so that said regulating means do not compensate disturbances which originate from regulation of said process.

13. Device according to claim 1, comprising means (23) for adding a time-decreasing ramp to said nominal value (c), triggering of said time-decreasing ramp being determined as a function of the control of sad quick-emptying solenoid valve.

14. Device according to claim 13, wherein said addition means (23) are triggered at the opening of aid emptying solenoid valve.

15. Device according to claim 1, comprising means (18) for desaturating said servomotor of said anti-surge valve when said deviation is lower than said second level (DSL).

16. Device according to claim 1, comprising means for counting, during a specific time, a number of occasions when said deviation between said nominal value and the measurement becomes greater than said first level (DSH), in order to trigger an alarm when said number is greater than a predetermined value.

17. Device according to claim 16, comprising means (25) for acting on a member (24) for regulating the process, in order to anticipate corrective action required of said anti-surge valve in case of a disturbance causing a parameter/nominal-value deviation greater than said first threshold (DSH).

18. Device according to claim 17, wherein said regulating member is an inlet valve (24) of said compressor.

19. Device according to claim 16, comprising means (26, 27, 28) for limiting conflict between regulation of the process and the anti-surge control from measurement/nominal-value deviation, acting on the output of said regulating means (13) so that said regulating means do not compensate disturbances which originate from regulation of the process.

20. Device according to claim 1, comprising means (25) for acting on a member (24) for regulating the process, in order to anticipate corrective action required of said anti-surge valve in case of a disturbance causing a parameter/nominal-valve deviation greater than said first threshold (DSH).

21. Device according to claim 20, wherein said regulating member is an inlet valve (24) of said compressor.

22. Device according to claim 20, comprising means (26, 27, 28) for limiting conflict between regulation of the process and the anti-surge control from the measurement/nominal-valve deviation, acting on an output of said regulating means (13) so that said regulating means do not compensate disturbances which originate from regulation of the process.

23. Device according to claim 1, comprising means (26, 27, 28) for limiting conflict between the regulation of the process and the anti-surge control from a measurement/nominal-value deviation, acting on the output of said regulating means (13) so that these do not compensate disturbances which originate from regulation of said process.

* * * * *